United States Patent [19]

de Villers et al.

[11] 4,285,432

[45] Aug. 25, 1981

[54] PACKAGE ARRANGEMENT FOR FRAGILE ARTICLES

[75] Inventors: Paul de Villers, VaudreuilsurleLac; Judith Barriault, Scarborough, both of Canada

[73] Assignee: Gestion Paul de Villers, Inc., VaudreuilsurleLac, Canada

[21] Appl. No.: 967,5[illegible]

[22] Filed: Dec. 7, 1978

[30] Foreign Application Priority Data

Nov. 21, 1978 [CA] Canada ..... 316557

[51] Int. Cl.[3] ..... B65D 81/08; B65D 81/10

[52] U.S. Cl. ..... 206/591; 206/497; 206/500

[58] Field of Search ..... 206/591, 594, 588, 500, 206/497, 320, 326, 418, 521

[56] References Cited

U.S. PATENT DOCUMENTS

| | | | |
|---|---|---|---|
| 1,146,515 | 7/1915 | Potter | 206/500 |
| 1,156,074 | 10/1915 | Hahn | 206/594 |
| 1,344,147 | 6/1920 | Potter | 206/594 |
| 1,691,736 | 11/1928 | Oppenheim | 206/594 |
| 2,277,674 | 3/1942 | Belsinger | 206/594 |
| 2,458,737 | 1/1949 | Salkowitz | 206/594 |
| 2,553,418 | 5/1951 | Loth | 206/591 |
| 3,057,468 | 10/1962 | Allan, Jr. | 206/594 |
| 3,231,454 | 1/1966 | Williams | 206/594 |
| 3,344,973 | 10/1967 | Studen | 206/523 |
| 3,750,872 | 8/1973 | Bobb | 206/497 |

*Primary Examiner*—Stephen P. Garbe

*Attorney, Agent, or Firm*—Alan Swabey; Robert Mitchell; Guy J. Houle

[57] ABSTRACT

The present invention relates to packaging for various fragile articles, including a method and particularly relates to the packaging of fragile articles such as glass lighting fixture globes including ones commonly known as "Tiffany" types.

6 Claims, 5 Drawing Figures

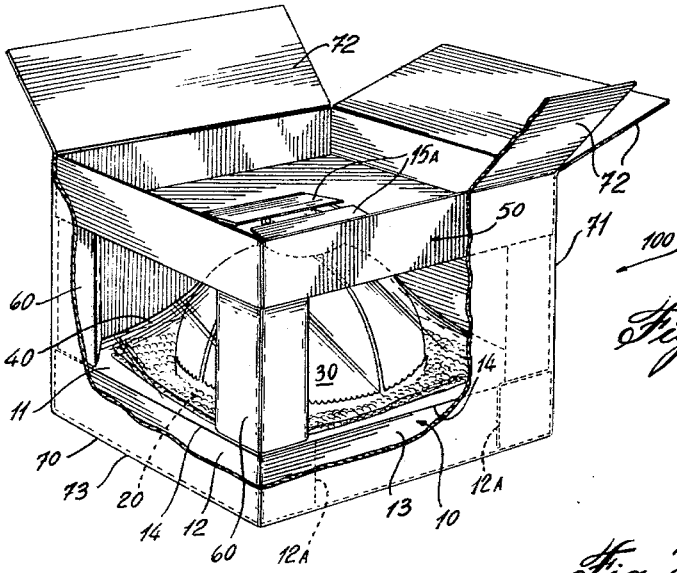
Fig. 1
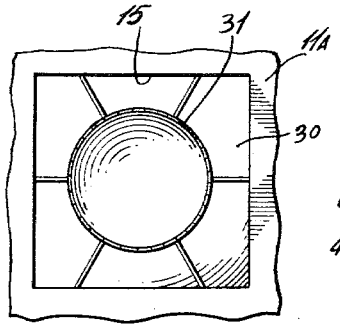
Fig. 4
Fig. 2
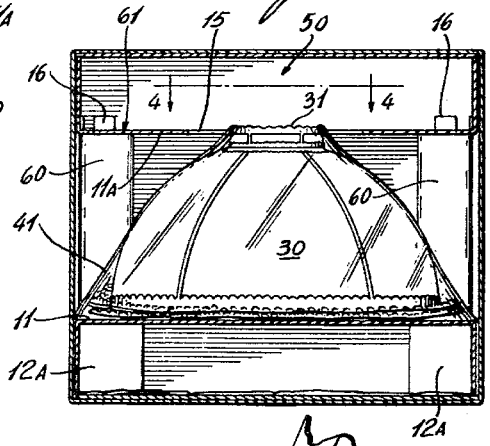
Fig. 3
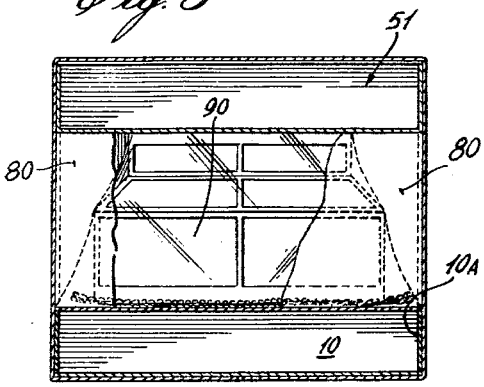
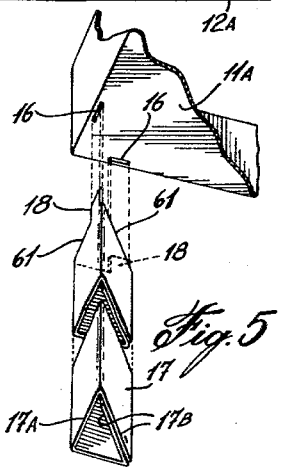
Fig. 5

PACKAGE ARRANGEMENT FOR FRAGILE ARTICLES

BACKGROUND OF THE INVENTION

Field of the Invention

The present invention relates to packaging for various fragile articles, including a method and particularly relates to the packaging of fragile articles such as glass lighting fixture globes including ones commonly known as "Tiffany" types.

The safe transportation of such aforementioned articles is a problem since it demands relatively expensive bulky and elaborate packaging, which has not, in some instances, proved successful in avoiding breakage.

SUMMARY OF THE INVENTION

It is therefore a prime object of the present invention to overcome the aforementioned problem by providing a relatively inexpensive compact and non-elaborate packaging arrangement, particularly for use in transportation of various fragile articles, as discussed above, including "Tiffany" globes.

It is a further object of the present invention to provide a novel method of packaging articles of the type discussed.

In one aspect of the present invention, there is provided a package arrangement comprising in combination:

(1) a container for a fragile article having side members which include top and bottom members, defining a protected space;

(2) an article in said space and located remote from said side members; and (3) means in said space cooperating with said side members and said article to thereby restrain movement of said article relative to said side members during movement of said container.

In a further aspect of the present invention, there is provided a package arrangement comprising in combination:

(1) a first member having a top surface defined by peripheral edges;

(2) shock absorbing resilient cushioning material on said top surface;

(3) an article located on said material and positioned within said peripheral edges;

(4) means securing said article in place on said material and said material to said first member;

(5) a second member positioned in spaced relation to said first member and adjacent to said article thereby sandwiching said article between said first and second members; and (6) means retaining said first and second members in said relative positions, one to another.

In a further aspect of the present invention, there is provided a package arrangement comprising in combination:

(1) a first member having a top surface defined by peripheral edges;

(2) shock absorbing resilient cushioning material on said top surface;

(3) an article located on said material and positioned within said peripheral edges;

(4) means securing said article in place on said material and said material to said first member;

(5) a second member positioned in spaced relation to said first member and located remote from said article;

(6) at least one third member located intermediate said first and second members and abutting said top surface for use in maintaining said first and second members in said spaced relation; and (7) means retaining said first, second and third members in said relative positions, one to another.

In a still further aspect of the present invention there is provided a method of packaging an article comprising the steps of:

(1) assembling an article support member, an article to be packaged and shock absorbing resilient cushioning material together such that said cushioning material lies intermediate said article and said support and said article is situated within the peripheral edges of said support; and (2) applying a film like material over said article and cushioning material and at least part of said support member and heat shrinking said film material in place to thereby provide means for securing said article indirectly to said support member.

BRIEF DESCRIPTION OF DRAWINGS

The invention is illustrated by way of example in the accompanying drawings wherein:

FIG. 1 is a part section oblique view of a package arrangement in accordance with the present invention;

FIG. 2 is a part section side elevational view of the package arrangement shown in FIG. 1;

FIG. 3 is a sectioned side elevational view of a further embodiment of a package arrangement in accordance with the present invention;

FIG. 4 is a view taken along line 4—4 in FIG. 2; and

FIG. 5 is a fragmented oblique view of a portion of the package arrangement shown in FIG. 2.

DESCRIPTION OF PREFERRED EMBODIMENTS

Referring in detail to the drawings. As will be seen in FIG. 1, there is shown a package arrangement 100 comprising a first member 10; shock absorbing resilient cushioning material 20 on the upper top surface of member 10; an article 30 located on the cushioning material 20 and positioned within the peripheral edges of member 10; means 40 securing the article 30 in place on the material 20 and securing the material 20 to first member 10; a second member 50 positioned in spaced relation to first member 10 and in spaced telescoped relation to the article 30; and a plurality of leg members 60 located intermediate the respective first and second members 10 and 50 for use in maintaining the same in spaced relation and means 70 retaining the respective members 10, 50 and 60 in selected relative positions, one to another.

In the alternative embodiment shown in FIG. 3, the plurality of leg members 60 are replaced by a single third member 80 which encloses the space situated between the members 10 and 50 and lies adjacent the peripheral edges of member 10. Members 10, 50, 60, 70 and 80 are all constructed of corrugated cardboard sheet.

First member 10 comprises a flat top surface 11 having a pair of depending wall members 12 and a pair of depending wall members 13 secured respectively to opposite peripheral edges 14 of surface 11. Wall members 12 include extensions 12A forming flap portions for securing to the inner faces of wall members 13, as best seen in FIG. 1. The extensions 12A are secured to members 13 by staples. As described, first member 10 represents a base for supporting article 30 and is constructed in a manner similar to that commonly used for the lid of a box.

Referring to FIG. 3, an alternative construction for member 10 is shown. In such instance, wall members 12 and 13 are eliminated and a single member 10A is utilized in place thereof extending around the peripheral edges 14 so as to support surface 11. End portions of member 10A (not shown) overlap one another and are stapled together. The alternative construction for member 10 accordingly provides a base similar to that discussed above using wall members 12 and 13.

The shock absorbing resilient cushioning material 20 illustrated in FIG. 1 is a well known packaging material known in the trade as "air caps"*. As may be seen in FIG. 2, material 20 has been laid on surface 11 in two layers, back to back, in such manner that the "air caps" which are bubble-like configurations rising from a flat surface, make contact with both surface 11 and article 30. Material 20 is arranged, as will be seen in FIGS. 1 and 3, so as to ensure article 30 is well supported thereon and not in direct contact with surface 11.

*Trade mark

Article 30, as illustrated in FIGS. 1 and 2, and article 90, as illustrated in FIG. 3, located upon material 20 is a well known "Tiffany" globe and as will be seen, for example, in FIG. 1 is located well inboard of the peripheral edges 14 and well above the bottom and well below the top of the container. It has been found during testing package arrangement 100, especially during drop testing, it is desirable to locate article 30 substantially inboard as discussed and accordingly within the peripheral edges 14 of surface 11.

Means 40 as best seen in FIGS. 1 and 2 is a clear film of plastic sheet material 41 overlying article 30 and material 20 and extending down the wall members 12 and 13 to be secured below first member 10. The film of plastic sheet material 41 is shrunk into place by suitable well known means such as a heat shrinking process. Material 41 accordingly, for example, positively secures article 30 in place on member 10 preventing any substantial relative movement therebetween.

Member 50 is of similar construction to that of member 10 differing only in that it has a flat surface 11A as shown in FIG. 2 which includes a rectangular aperture 15 to permit the top portion 31 of article 30 to project therethrough. Thus no pressure is exerted upon article 30 by member 50 by virtue of the clearance provided between the two items. Alternatively, aperture 15 may be eliminated if desired and leg members 60, discussed hereinafter, extended in length to that shown in the drawings so that surface 11A lies above and is spaced from the top of article 30 thereby locating member 50 even more remotely from article 30 to that shown in the drawings. For reasons of clarity, flap portions 15A have been omitted in FIG. 2. Flap portions 15A perform no function and if desired can be eliminated. The result merely from an operation in providing the aperture 15 during manufacture.

Apart from the foregoing, member 50 further differs from member 10 in regard to the embodiment shown in FIGS. 1 and 2 in that apertured slots 16 are provided, as best seen in FIG. 5, for receiving detachable leg members 60.

Leg members 60 are constructed as will be clearly seen in FIG. 5, from a one piece sheet of material 17 folded so as to form a triangular tube 17A having end portions 17B overlapping completely one with another and secured one to another by stapling, to form a side of triangular tube 17A. A pair of tongue portions 18 extend adjacent one end of triangular tube 17A and are adapted to enter slots 16, as best seen in FIG. 2. When correctly assembled, leg members 60 support member 50 along end face 61 of leg member 60 as it abuts the flat surface 11A of member 50. Referring to FIG. 1, it will be clearly seen the opposite ends of leg members 60 rest upon surface 11 of member 10 adjacent peripheral edges thereof. Leg members 60 accordingly are located intermediate members 10 and 50 to provide means to maintain the same in spaced relation.

Turning to the alternative embodiment as disclosed in FIG. 3, there is disclosed a package arrangement substantially identical to that disclosed in FIGS. 1 and 2 except that no aperture 15 is provided in member 51 for protrusion of article 90 secured in similar manner to that discussed in reference to article 30, and no slots 16 are provided. As will be seen, member 51 sits substantially in contact with article 90 substantially abutting the upper edge portion thereof. Use of member 80 is entirely optional and can be used if desired. Accordingly, member 80 may be eliminated allowing the article 90 to maintain the spaced relation of members 51 and 10. Such would be utilized where article 90 is of less fragile character and not requiring the additional packaging support as provided by member 80.

Member 80 although shown in position in FIG. 3, for reasons of convenience, may be used, as discussed above in respect of the embodiment as shown in FIGS. 1 and 2 replacing leg members 60.

Means 70 comprises a container 71 rectangular in shape, having sides including a base 73 and top flaps 72 and adapted to receive members 10, 50 and 60 including article 30 secured in position as discussed, or alternatively members 10, 50 and 80 and article 30 secured in position as discussed, or alternatively members 10, 51 and article 90 secured in similar manner to that discussed in respect of article 30. Container 71 is basically a commonly known carton constructed of corrugated cardboard. Top flaps 72 are for use in enclosing the contents of container 71. Referring to FIG. 1, it will be noted that flaps 72 when folded down and secured by tape or the like to enclose the contents of container 71, cooperate with base 73 to secure the contents of container 71 which may comprise for example members 10, 50 and 60 preventing movement of said latter members relative to one another and container 71. As will be further seen in FIG. 1, members 10 and 50 fit snuggly within container 71 adjacent the side walls thereof thus preventing lateral movement. It will be readily realized alternative suitable materials to those discussed above may be substituted with respect to the packaging arrangement as discussed.

We claim:

1. A package arrangement comprising in combination:

a first member having a top surface defined by peripheral edges;

shock absorbing resilient cushioning material on said top surface;

an article located on said material and positioned within said peripheral edges;

means securing said article in place on said material and said material to said first member;

a second member positioned in spaced relation to said first member and located above and spaced from said article;

a plurality of post-like members being tubular and triangular in cross section, located intermediate said first and second members and abutting said top surface for use in maintaining said first and second members in said spaced relation; and means retaining said first, second and post-like members in said relative positions, one to another.

2. A package arrangement comprising in combination:

a first member having a top surface defined by peripheral edges and a plurality of wall members depending downwardly from said peripheral edges to thereby provide support for said top surface;

at least one layer of shock absorbing resilient cushioning material on said top surface;

an article located on said cushioning material and remote from said top surface and positioned a selected distance from said peripheral edges;

a film of material tensioned over said article, cushioning material and top surface and secured adjacent said first member to thereby positively secure said article, cushioning material and first member together and prevent relative movement therebetween;

a second member having a lower surface defined by peripheral edges, a plurality of wall members projecting upwardly from said peripheral edges, said second member being positioned in spaced relation to said first member and located in spaced telescoped relation from said article and film of material covering said article;

a plurality of post-like members positioned intermediate said first and second members and abutting said top surface adjacent said peripheral edges, thereby maintaining said first and second members in spaced relation and said second member remote from said article and film of material covering the same; said members including means for use in connecting to an adjacent member; and a container for receiving said first member, cushioning material, article, film of material, second member and post-like members, said container including side members defining a protected space and wherein one of said side members includes movable flap portions for use in providing access into said container, said container providing means together with said post-like members to retain said first and second members in said spaced relation and including preventing relative movement therebetween.

3. A package arrangement comprising in combination:

a first member having a top surface defined by peripheral edges and a plurality of wall members depending downwardly from said peripheral edges to thereby provide support for said top surface;

at least one layer of shock absorbing resilient cushioning material on said top surface;

an article located on said cushioning material and remote from said top surface and positioned a selected distance from said peripheral edges;

a film of material tensioned over said article, cushioning material and top surface, and secured adjacent said first member to thereby positively secure said article, cushioning material and first member together and prevent relative movement therebetween;

a second member having a lower surface defined by peripheral edges, a plurality of wall members projecting upwardly from said peripheral edges, said second member being positioned in spaced relation to said first member and located in spaced telescoped relation from said article and film of material covering said article;

a plurality of post-like members being triangular and tubular in cross section, positioned intermediate said first and second members and abutting said top surface adjacent said peripheral edges, thereby maintaining said first and second members in spaced relation and said second member remote from said article and film of material covering the same; and a container for receiving said first member, cushioning material, article, film of material, second member and post-like members, said container including side members defining a protected space and wherein one of said side members includes movable flap portions for use in providing access into said container, said container providing means together with said post-like members to retain said first and second members in said spaced relation and including preventing relative movement therebetween.

4. A package arrangement comprising in combination a container for a fragile article with said container having a plurality of wall members defining a protected space; an article in said space and located remote from said wall members; and means in said space cooperating with said wall members and said article to thereby restrain movement of said article relative to said wall members during movement of said container, said means in said space comprising a first member secured within said container, said first member comprising an article support having an article supporting surface thereon defined by peripheral edges, said article support being secured in spaced relation to a selected one of said wall members and said article being positioned on said surface and located spaced from said peripheral edges and said wall members; means positively securing said article to said supporting surface to prevent movement of said article relative to said surface; a second member secured within said container, said second member comprising a support having a supporting surface thereon, said supporting surface of said second member being located in spaced telescoped relation to said article, said supporting surface of said second member being in fixed spaced relation to the wall member located on the opposite side of the container to that of said selected wall member; said means positively securing said article to said supporting surface of said first member comprising a film material applied by a known heat shrink process, a plurality of post-like members abutting said article supporting surfaces and maintaining said first and second members in spaced relation, said post-like members comprising elongated tubes of triangular cross-section, said article supporting surfaces both being rectangular in shape and said plurality of post-like members four in number, and each post-like member being located adjacent said peripheral edges at respective corners of said rectangular surfaces.

5. A package arrangement as defined in claim 4 wherein at least said first member includes members which extend in a direction away from at least two of said peripheral edges to thereby provide support for said article support.

6. A package arrangement comprising in combination a container for a fragile article with said container having a plurality of wall members defining a protected space; an article in said space and located remote from said wall members; and means in said space cooperating with said wall members and said article to thereby restrain movement of said article relative to said wall members during movement of said container, said means in said space comprising a first member secured within said container, said first member comprising an article support having an article supporting surface thereon defined by peripheral edges, said article support being secured in spaced relation to a selected one of said wall members and said article being positioned on said supporting surface and located spaced from said peripheral edges and said wall members; means positively securing said article to said supporting surface to prevent movement of said article relative to said surface; a second member secured within said container, said second member comprising a support having a supporting surface thereon, said supporting surface of said second member being located in spaced telescoped relation to said article, said supporting surface of said second member being in fixed spaced relation to the wall member located on the opposite side of the container to that of said selected wall member; said means positively securing said article to said supporting surface of said first member comprising a film material applied by a known heat shrink process, a plurality of post-like members abutting said article support surfaces and maintaining said first and second members in spaced relation, said post-like members including means for use in connecting to an adjacent one of said members.

* * * * *